US005207932A

United States Patent [19]

Norman et al.

[11] Patent Number: 5,207,932

[45] Date of Patent: May 4, 1993

[54] ALCOHOL RESISTANT AQUEOUS FILM FORMING FIREFIGHTING FOAM

[75] Inventors: Edward C. Norman, Chester Springs; Anne C. Regina, Coatesville, both of Pa.

[73] Assignee: Chubb National Foam, Inc., Lionville, Pa.

[21] Appl. No.: 666,989

[22] Filed: Mar. 11, 1991

Related U.S. Application Data

[63] Continuation-in-part of Ser. No. 383,141, Jul. 20, 1989, Pat. No. 4,999,119.

[51] Int. Cl.[5] ..... A62D 1/02; A62D 1/04

[52] U.S. Cl. ..... 252/3; 252/8.05

[58] Field of Search ..... 252/3, 8.05

[56] References Cited

U.S. PATENT DOCUMENTS

| | | | |
|---|---|---|---|
| 3,772,269 | 11/1973 | Lew | 260/210 |
| 4,060,489 | 11/1977 | Chiesa, Jr. | 252/3 |
| 4,387,032 | 6/1983 | Chiesa, Jr. | 252/3 |
| 4,424,133 | 1/1984 | Mulligan | 252/8.05 |
| 4,439,329 | 3/1984 | Kleiner et al. | 252/8.05 |
| 4,565,647 | 1/1986 | Llenado | 252/3 |
| 4,859,349 | 8/1989 | Clark et al. | 252/3 |

*Primary Examiner*—Richard D. Lovering
*Assistant Examiner*—Joseph D. Anthony
*Attorney, Agent, or Firm*—Anna E. Mack

[57] ABSTRACT

AFFF and ARAFFF firefighting foam concentrates which include alkyl polyglycoside surfactants are provided. These surfactants enhance the performance of the perfluoroalkyl surfactants.

32 Claims, No Drawings

ALCOHOL RESISTANT AQUEOUS FILM FORMING FIREFIGHTING FOAM

This is a continuation-in-part of application Ser. No. 07/383,141 filed Jul. 20, 1989, now U.S. Pat. No. 4,999,119.

BACKGROUND AND BRIEF SUMMARY OF THE INVENTION

Firefighting foam concentrates are mixtures of foaming agents, solvents and other additives. These concentrates are intended to be mixed with water usually at either a 3% or 6% concentration, the resulting solution is then foamed by mechanical means and the foam is projected onto the surface of a burning liquid.

A particular class of firefighting foam concentrates is known as an aqueous film-forming foam (AFFF or AF³). AFFF concentrates have the quality of being able to spread an aqueous film on the surface of hydrocarbon liquids, enhancing the speed of extinguishment. This is made possible by the perfluoroalkyl surfactants contained in AFFF. These surfactants produce very low surface tension values in solution (15–20 dynes $cm^{-1}$) which permit the solution to spread on the surface of the hydrocarbon liquids.

AFFF foams are not effective on water soluble fuels, such as alcohols and the lower ketones and esters, as the foam is dissolved and destroyed by the fuel. There is a sub-class of AFFF foam concentrates known as alcohol resistant AFFF (ARAFFF or ARAF³). ARAFFF concentrates contain a water soluble polymer that precipitates on contact with a water soluble fuel providing a protective layer between the fuel and the foam. ARAFFF foams are effective on both hydrocarbons and water soluble fuels.

Typical AFFF concentrates contain one or more perfluoroalkyl surfactants which may be anionic, cationic, nonionic or amphoteric, one or more nonfluorinated surfactants which may be anionic, cationic, amphoteric or nonionic, solvents such as glycols and/or glycol ethers and minor additives such as chelating agents, pH buffers, corrosion inhibitors and the like. Many U.S. patents have disclosed such compositions, such as U.S. Pat. Nos. 3,047,619; 3,257,407; 3,258,423; 3,562,156; 3,621,059; 3,655,555; 3,661,776; 3,677,347; 3,759,981; 3,772,199; 3,789,265; 3,828,085; 3,839,425; 3,849,315; 3,941,708; 3,952,075; 3,957,657; 3,957,658; 3,963,776; 4,038,198; 4,042,522; 4,049,556; 4,060,132; 4,060,489; 4,069,158; 4,090,976; 4,099,574; 4,149,599; 4,203,850; and 4,209,407.

ARAFFF concentrates are essentially the same as AFFF's, only with the addition of a water soluble polymer. These compositions are disclosed in U.S. Pat. No. 4,060,489; U.S. Pat. No. 4,149,599 and U.S. Pat. No. 4,387,032.

A common element in all AFFF and ARAFFF compositions is the perfluoroalkyl surfactant. This type of surfactant represents 40–80% of the cost of the concentrate.

We have unexpectedly discovered that by the use of alkyl polyglycoside surfactants it is possible to reduce the necessary concentrations of the perfluoroalkyl surfactants in AFFF compositions by more than 40% without loss of firefighting performance. Similarly, in ARAFFF compositions, the use of alkyl polyglycoside surfactants has produced an unexpected improvement in firefighting performance on water soluble fuels and has made possible the use of less expensive water soluble polymers. The polymer commonly used in ARAFFF compositions is Kelco K8A13, an anionic polysaccharide of the formula $C_{107}H_{158}O_{190}K_5$, produced by the Kelco Division of Merck and Company. This polymer is believed to be a chemically modified xanthan gum and costs approximately seven (7) times the cost of ordinary industrial grade xanthan gum.

Using surfactant systems disclosed in the prior art, it has been impossible to attain satisfactory ARAFFF performance on water soluble fuels with industrial grade xanthan gum without using so high a concentration of the gum that the composition become unacceptably viscous. However, we have discovered that by the inclusion of alkyl polyglycosides as surfactants, ARAFFF compositions using ordinary industrial grade xanthan gum will perform as well as or better than the ARAFFF compositions made with Kelco K8A13 and the surfactant systems disclosed in the past.

Alkyl glycosides and alkyl polyglycosides are known surfactants. A particularly useful class of polyglycosides for purposes of the invention is that marketed by the Horizon Chemical Division of Henkel, Inc. under the tradename "APG".

A typical molecular structure is shown below.

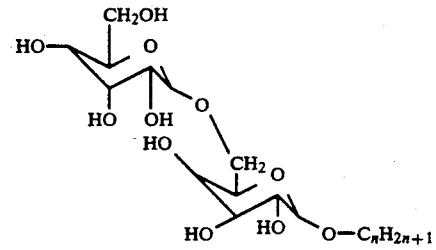

The superior performance of the alkyl polyglycosides in the fire fighting compositions is totally unexpected because of the very low interfacial tension values of alkyl polyglycoside compositions with hydrocarbons. It is normally desirable to use co-surfactant systems with relatively high interfacial tension values to avoid emulsification of fuel in the foam. Exemplary interfacial tension values are set forth below.

TABLE I

| Surfactant | Concentration | Interfacial Tension Mineral Oil |
|---|---|---|
| $C_{12-15}$ Polyglycoside | 0.01% | 0.9 dynes/cm |
| $C_{12}$ Linear alkane sulfonate | 0.01% | 7.2 dynes/cm |
| $C_{12-15}$ $^{EO}$ ether sulfate | 0.01% | 7.4 dynes/cm |
| $C_{8-10}$ Imidazoline dicarboxylate (mona CCMM-40) | 0.01% | 15.8 dynes/cm |

Broadly, the invention comprises, in one embodiment, an AFFF composition firefighting concentrate comprising a perfluoroalkyl surfactant, a solvent and an effective amount of an alkyl polyglycoside. The invention, in another embodiment, broadly comprises a ARAFFF firefighting concentrate composition having a perfluoroalkyl surfactant, a solvent, a water soluble polymer and an effective amount of an alkyl polyglycoside.

The phrase, "an effective amount", means the use of the poly alkylglycoside in an amount such that the composition when used as a firefighting concentrate, meets or exceeds those standards which determine the acceptability of the concentrate for firefighting purposes.

DESCRIPTION OF THE PREFERRED EMBODIMENT

The invention comprises an AFFF composition containing an alkyl polyglycoside having the formula:

$$C_nH_{2n+1}O(C_6H_{10}O_5)_xH$$

wherein n=4–18, preferably 6–12 and x=1–6, preferably 1–2.

Additionally these compositions preferably contain an amphoteric perfluoroalkyl surfactant of the formula:

$$R_FCH_2CH_2SO_2NHCH_2CH_2CH_2N^+(CH_3)_2CH_2COO^-$$

and/or $$R_FCH_2CH_2SO_2NHCH_2CH_2CH_2N(CH_3)_2\rightarrow O$$

and/or $$C_6F_{13}CH_2CH_2SO_2NHCH_2CH_2CH_2N(CH_3)_2CH_2.CH_2COO^-,$$

and optionally, a cationic perfluouroalkyl surfactant of the formula $R_FCH_2CH_2X^+I-$ where: RF is a perfluoroalkyl chain of the formula $C_nF_{2n+1}$ where n=4 to 18; and X represents a pyridium, substituted pyridium or other quaternary ammonium radical; and an anionic surfactant of the formula:

$$C_nH_{2n+1}OSO_3Na$$

wherein the value of n=8 to 18; and a glycol ether selected from the group consisting of:
1-Butoxy-2-ethanol
1-Ethoxy-2-ethanol
1-Butoxyethoxy-2-ethanol
1-Butoxyethoxy-2-propanol,
and a glycol selected from the group consisting of:
1,2 ethanediol
1,2 propanediol
1,3 propanediol
1,3 butanediol
1,4 butanediol;
and a nonionic surfactant of the formula

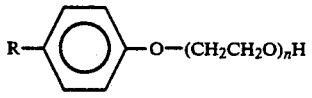

wherein R=octyl or nonyl and n=2 to 15; and a sequestering agent chosen from salts of ethylene diamine tetraacetic acid and salts of nitrilo-tris acetic acid. For example, NTA/$Na_3$, $Na_2$ EDTA (Sequestrene $Na_2$), and $Na_4$ EDTA (Sequestrene 220 and Vanate TS) can all be used as chelation/sequestering agents to enhance performance in sea water. In ARAF[3], EDTA complexes are used to enhance biocide capabilities. Other optional ingredients include Trishydroxymethylaminomethane (Tris Amino) which may be used as a pH buffer in AF[3] systems, and/or urea which when used in combination with Tris Amino, acts as a pH buffer especially for premix storage at elevated temperatures in military formulations and may be included as a refractive index modifier. In ARAF[3] urea may be used as an aid for freeze thaw stability.

Sodium decylsulfate used in combination with APG surfactant will enhance the expansion of the foam and defray the cost of APG. Butyl carbitol and ethylene glycol are used as refractive index modifiers, freeze point depressants and foam stabilizers.

Nipacide MX and Kathon CG/ICP are used in ARAF[3] as biocides. Sodium benzoate, sodium tolyltriazole, sodium mercaptobenzothiazole, hydroxyphosphorocarboxylic acids and derivatives thereof are used as corrosion inhibitors. The concentrates may also optionally contain preservatives such as oxazolidine, imidazolidinyl urea, chlorophenols, isothiazolinones etc. and preservative adjuvants such as salts of ethylene diaminetetraacetic acid or nitrilotrisacetic acid in effective amounts to protect against microbial attack. $MgSO_4$ is optionally included to enhance fresh water performance.

The invention further comprises ARAFFF compositions having, in addition to the foregoing, a polysaccharide polymer, preferably a heteropolysaccharide polymer such as xanthan gum, gum tragacanth, locust bean gum, or guar gum; and a preservative such as orthophenylphenol or dichlorophene.

Relative ranges of the components of the composition are as follows for:

| 3% AFFF | by weight |
|---|---|
| Perfluoroalkyl surfactant | 0.5–3.0%, preferably 0.8–2.6% |
| Magnesium sulfate | 0–1.0%, preferably 0.2–0.6% |
| Glycol | 0–10%, preferably 2.0–7.0% |
| Alkyl polyglycoside surfactant | 1.0–10.0%, preferably 4.0–8.5% |
| nionic surfactant | 0–6.0%, preferably 0–5.0% |
| Glycol ether | 4.0–20.0%, preferably 5.0–15.0% |
| Nonionic surfactant | 0–2.0%, preferably 0–1.5% |
| Sequestering agent | 0–1.0%, preferably 0.1–0.5% |
| Buffering agent | 0–2.0%, preferably 0.5–1.0% |
| Corrosion inhibitors | 0–2.0%, preferably 0.1–0.8% |
| Water | Balance |

It will be recognized by those skilled in the art that AFFF concentrates intended for mixing with water in percentages other than 3% can be made by multiplying the percentage compositions above by the factor 3/x where x represents the desired mixing percentages.

Relative ranges of the components of the composition are as follows for:

| ARAFFF for use at 3% on hydrocarbon fuels and at 6% on water soluble fuels | |
|---|---|
| Alkyl polyglycoside surfactant | 1.0–10.0%, preferably 2.0–6.0% |
| Perfluoroalkyl surfactant | 0.8–2.0%, preferably 1.0–1.5% |
| Anionic surfactant | 2.0–5.0%, preferably 2.2–3.5% |
| Glycol ether | 2.0–5.0%, preferably 3.0–4.0% |
| Glycol | 0–5.0%, preferably 0–4.0% |
| Sequestering agent | 0.1–1.0%, preferably 0.1–0.3% |
| Buffering agents | 0–2.0%, preferably 0–1.7% |
| Magnesium sulfate | 0–1.0%, preferably 0.2–0.7% |
| Polysaccharide | 0.5–1.5%, preferably 0.8–1.0% |
| Water | Balance |

Typically these ARAFFF concentrates are diluted to a 3% concentration for hydrocarbon fuel based fires and to a 6% concentration for use on water soluble based fuel fires. However by incorporating slightly higher amounts of fluorosurfactant and polymer into the APG containing composition, a 3% concentration may be employed to extinguish both types of fires (i.e. hydrocarbon fuel based fires and water soluble fuel based fires).

Relative ranges of the components of the composition are as follows for:

| ARAFFF for use at 3% on hydrocarbon fuels and at 3% on water soluble fuels | |
|---|---|
| Alkyl polyglycoside surfactant | 1.0–10.0%, preferably 2.0–6.0% |
| Perfluoroalkyl surfactant | 0.8–2.0%, preferably 1.0–1.6% |
| Anionic surfactant | 0–5.0%, preferably 3.0–4.0% |
| Glycol ether | 2.0–5.0%, preferably 3.0–4.0% |
| Glycol | 0–5.0%, preferably 0–4.0%0 |
| Sequestering agent | 0.1–1.0%, preferably 0.1–0.3% |
| Buffering agents | 0–2.0%, preferably 0–1.0% |
| Magnesium sulfate | 0–1.0%, preferably 0.2–0.7% |
| Polysaccharide | 1.0–2.0%, preferably 1.2–1.5% |
| Water | Balance |

Fire Testing

In the examples below, the following tradename ingredients are used having the activities specified. "Activity" can be considered as the effective concentration of chemical in solution. For example, a 27% active solution of Forafac 1157N contains 27% of fluoroalkyl betaine, 11% ethanol and the balance water. APG-325 is supplied as a 50% or 70% solution with the solvent water. Sodium decylsulfate is 30% active. Solvents such as ethylene glycol and butyl carbitol are considered to be 100% active, as are most solids (K8A13, Rhodopol, Urea, Tris amino, etc.).

Forafac 1157N is an amphoteric perfluoroalkyl surfactant manufactured by Atochem, Inc. as a 27% active solution of $RFCH_2CH_2SO_2NHCH_2CH_2CH_2N^+(CH_3)_2CH_2COO^-$.

APG 300 and APG 325CS are 50% active alkyl polyglycosides manufactured by the Horizon Chemical Division of Henkel, Inc.

Triton X-102 is a nonionic octylphenol ethoxylate manufactured by the Rohm & Haas Company.

Forafac 1183N is an amphoteric perfluoralkyl surfactant, manufactured by Atochem, Inc. as a 40% active solution of

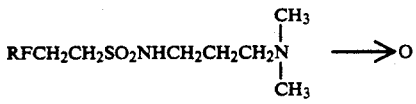

Surflon S831-2 is a nonionic perfluoroalkyl surfactant manufactured by Asahi Glass Co.

Butyl Carbitol (1-butoxyethoxy-2-ethanol) is manufactured by the Union Carbide Co.

NTA/$Na_3$ (Nitrilo trisacetic acid trisodium salt) is manufactured by W.R. Grace & Co.

Tris Amino [Tris (hydroxymethyl) amino methane] is manufactured by Angus Chemical Co.

IDC 810M is an imidazoline dicarboxylate amphoteric surfactant sold by Mona Industries under the tradename "Monateric CCMM-40".

Lodyne S-106A is a 30% active cationic perfluoroalkyl surfactant, Lodyne S-103A is a 45% active anionic perfluoroalkyl surfactant, and Lodyne K81'84 is a 30% active nonionic perfluoroalkyl surfactant. All three compositions are available commercially from the Ciba-Geigy Corporation.

Deteric LP is a 30% active partial sodium salt of N-alkyl-β-iminodipropionic acid available commercially from DeForest, Inc.

Rhodopol 23 is an industrial grade of xanthan available commercially from R.T. Vanderbilt having a purity of about 87–97%.

Kathon CG/ICP (5-chloro-2-methyl-4-isothiazolin-3-one mixture with 2-methyl-4-isothiazolin-3-one) is a preservative manufactured by the Rohm & Haas Company.

Givgard G-4-40 is 40% active solution of dichlorophene manufactured by Givaudan, Inc.

Lodyne K78-220B is a perfluoroalkyl sulfide-terminated oligomer of the type described in Example 1 of the U.S. Pat. No. 4,460,480 manufactured by the Ciba-Geigy Corporation.

Each concentrate was tested in a fire laboratory using miniaturized models of full scale fire tests described below.

Mil-Spec—Mil-F-24385C—MOD Test Procedure

The liquid concentrate is tested as a premixed solution containing 3 parts of concentrate with 97 parts of water according to the following procedure.

Three liters of regular motor gasoline, conforming to VV-G-1690 is placed into a round fire pan that is 2.69 $ft^2$ in area and 4½" deep, containing 2½" of water and ignited. After a 10 second preburn, a foam discharge delivering 0.108 gpm of solution is directed for 90 seconds over the center of the fire pan in a spray type pattern that produces a foam quality that conforms to requirement 4.7.5 of Mil-F-24385C. Immediately after the 90 second foam application, a jet (5/32" diameter) of propane gas is ignited and placed over the center of the foam blanket at the rate of 40 cc/m. metered by a full view Rotameter model 8900D, manufactured by Brooks Instrument Div. Emerson Electric Co., King of Prussia, Pa., or equivalent. The impingement of the propane flame commences two inches above the top of the tank and shoots downwardly over the foam blanket until 25% of the foam blanket has been consumed by fire. The resulting heat flux is monitored and recorded by means of a water cooled calorimeter such as model C-1301-A-15-072 manufactured by Hy-Cal-Engineering, Santa Fe Springs, Calif., or equivalent, and a suitable Strip Chart Recorder capable of handling 1–5 M.V.

The time required to completely extinguish the fire and the time required for the propane jet to destroy 25% of the foam blanket are recorded as "Extinguishment" and "Burnback" times respectively. This test is a model of the 50 $ft^2$ fire test in U.S. Military Specification Mil-F-24-24385C.

U.L. 162 5th Edition—MOD Test Procedure

Isopropyl Alcohol Test

The liquid concentrate is tested as a premixed solution containing 6 parts of foam concentrate and 94 parts of water or three parts of foam concentrate and 97 parts of water. 15 liters of 99% isopropyl alcohol are placed into a round pan that is 2.69 $ft^2$ in area and 4½" deep, and ignited. After one minute of free burning a foam discharge delivering 0.269 gpm's of solution is directed onto the far wall of the fire pan in a solid stream application for two minutes, (Type II Fixed Nozzle) application that produces a foam quality that conforms to UL 162 5th Edition paragraphs 15–15.9. Immediately after the two minute foam application, a jet (5/32" diameter) of propane gas is ignited and discharged over the center of the foam blanket at the rate of 100 cc/m. metered by a full view Rotameter, Model 8900D as manufactured by Brooks Instrument Div. Emerson Electric Col, King of Prussia, Pa. or equivalent.

The impingement of the propane flame commences two inches above the top of the tank and shoots downwardly over the foam blanket. The resulting heat flux is monitored and recorded by means of a water cooled Calorimeter such as Model C-1301-A-15-072 manufactured by Hy-Cal-Engineering, Santa Fe Springs, Calif., or equivalent and a suitable Strip Chart Recorder capable of handling 1–5 MV until 20% of the foam blanket has been consumed by fire.

This test is a model of the fire test described in UL 162 5th Edition. The time required for 90% control, extinguishment and 20% burnback are recorded.

UL 162 5th Edition MOD Test Procedure

Heptane Test

The liquid concentrate is tested as a premixed solution containing 3 parts of concentrate and 97 parts of water. The test equipment is the same as that used for the isopropyl alcohol test. The procedures differ in that the foam application is Type III, the fuel is n-heptane, the application rate is 0.108 gpm and the application time is 2 minutes. The times for 90% control and 20% burnback are recorded.

The concentrates were prepared according to standard practice, that is simply blending the materials in a mixer.

The values shown as specifications for the fire tests conducted in the 2.69 $ft^2$ tank are typical values obtained for the respective types of concentrates tested, and should not be taken to be the official specifications of any approval agency or government.

Example 1

| Materials | A | B | C |
|---|---|---|---|
| 1. Water | 226 ml | 242 ml | 242 ml |
| 2. Forafac 1157N | 33.8 g | 33.8 g | 33.8 g |
| 3. Forafac 1183N | 16.9 g | 16.9 g | 16.9 g |
| 4. Butyl carbitol | 67.4 ml | 67.4 ml | 67.4 ml |
| 5. IDC-810M | 66.6 ml | | |
| 6. Sodium decylsulfate | 83.2 ml | 83.2 ml | 83.2 ml |
| 7. Triton X-102 | 4.2 ml | 4.2 ml | 4.2 ml |
| 8. $MgSO_4$ | 2.0 g | 2.0 g | 2.0 g |
| 9. Sodium benzoate | 2.0 g | 2.0 g | 2.0 g |
| 10. Tolyltriazole | 0.5 g | 0.5 g | 0.5 g |
| 11. APG 300 (light) | — | 50 g | — |
| (dark) | — | — | 50 g |
| 13. Acetic acid to adjust to pH 7.4–7.8 | | | |

Fire Test Results
Modified Mil-F-24385C

| Total Seconds | Ext. | 25% Burnback | Exp | QDT |
|---|---|---|---|---|
| 3% sea water on 3 liters gasoline | | | 0.04 gpm 2.69 $ft^2$ tank | |
| A. 106 | 0'51" | 4'25" | 10.29 | 2'30" |
| B. 87 | 0'38" | 5'30" | 10.74 | 2'42" |
| C. 90 | 0'42" | 7'00" | 10.56 | 2'58" |

-continued

Fire Test Results
Modified Mil-F-24385C

| Total Seconds | Ext. | 25% Burnback | Exp | QDT |
|---|---|---|---|---|
| Spec | 0'50" max | 5'00" min | | |

Exp = Expansion ratio of foam
QDT = 25% drainage time of foam

Composition A of Example 1 was the control. In inventive formulations B and C, the standard amphoteric surfactant IDC-819M was deleted and the alkyl polyglycoside APG 300 light (B) and dark (C) substituted therefor. Compositions B and C demonstrated better results were achieved with the formulations of the invention. The extinguishing times (Ext.) for compositions B and C were quicker and the burnback times were longer.

Example 2

| Materials | A | B | 1 liter C |
|---|---|---|---|
| 1. Water | 751 ml | 757 ml | 753 ml |
| 2. Urea | 12.4 g | 12.4 g | 12.4 g |
| 3. Butyl carbitol | 39 ml | 39 ml | 39 ml |
| 4. K8A13 | 11.3 g | 10.2 g | 9.0 g |
| 5. G-4-40 | 2.9 g | 2.9 g | 2.9 g |
| 6. Forafac 1157N | 46.6 g | 41.4 g | 46.6 g |
| 7. APG-325 | 80 g | 80 g | 80 g |
| 8. Sodium decylsulfate | 113 ml | 113 ml | 113 ml |
| 9. $MgSO_4$ | 5.0 g | 5.0 g | 5.0 g |
| 10. $NTA/NA_3$ | 1.6 g | 1.6 g | 1.6 g |
| 11. Acetic Acid/50% NaOH to adjust pH 7.6–8.00 | | | |

Fire Test Results
Modified UL-162

| Exp | QDT | 90% Control | Ext. | 20% Burnback | |
|---|---|---|---|---|---|
| 3% sea water on 10 liters heptane | | | | 0.04 gpm 2.69 $ft^2$ tank | |
| A. 7.42 | 7'48" | 0'35" | — | 4'45" | |
| B. 7.47 | 6'46" | 0'33" | — | 5'00" | |
| C. 7.95 | 6'39" | 0'45" | — | 4'45" | |
| Spec 3.5 min | 2'00" min | 0'50" max | N/A | 3'00" min | |
| 6% sea water on 15 liters IPA | | | | 0.10 gpm 2.69 $ft^2$ tank | |
| A. 6.47 | 23'01" | 1'06" | 1'15" | 1'51" | 7'00" |
| B. 6.10 | 25'25" | 0'38" | 1'12" | 1'47" | 6'45" |
| C. 5.66 | 19'53" | 0'48" | 1'10" | 1'55" | 6'05" |
| Spec 7.0 min | 10'00" min | 1'15" max | 1'45" max | 2'00" max | 5'00" max |

In Example 2, Composition A was the control. The polysaccharide K8A13 and the perfluoroalkyl surfactant were reduced 10% in Composition B and the polysaccharide K8A13 was reduced 20% in Composition C. With the presence of the alkyl polyglycoside the compositions of the invention still had satisfactory performances.

Example 3

| Materials | A | B | 1 gallon C |
|---|---|---|---|
| 1. Water | 2201 ml | 2245 ml | 2092 ml |
| 2. Surflon S-831-2 | 12 g | 10 g | 9.6 g |
| 3. Butyl carbitol | 200 ml | 200 ml | 200 ml |
| 4. Ethylene glycol | 220 g | 220 g | 220 g |
| 5. Forafac 1157N | 284 g | 242 g | 227.2 g |
| 6. APG-325 | 488 g | 488 g | 586 g |

-continued

Example 3

| Materials | A | B | 1 gallon C |
|---|---|---|---|
| 7. Triton X-102 | 44 ml | 44 ml | 53 ml |
| 8. NTA/$Na_3$ | 6 g | 6 g | 6 g |
| 9. Tris Amino | 12.5 g | 12.5 g | 12.5 g |
| 10. Urea | 12.5 g | 12.5 g | 12.5 g |
| 11. Sodium decylsulfate | 305 ml | 305 ml | 305 ml |
| 12. Acetic Acid/50% NaOH to adjust pH 7.6–8.0 | | | |

Fire Test Results
Modified Mil Spec

| Total Seconds | Ext. | 25% Burnback | Exp | QDT |
|---|---|---|---|---|
| 3% sea water on 3.0 liters gasoline | | | 0.04 gpm 2.69 $ft^2$ tank | |
| A. 98 | 0'43" | 4'27" | 8.04 | 2'22" |
| B. 79 | 0'37" | 4'58" | 7.23 | 2'39" |
| C. 88 | 0'38" | 4'30" | 7.20 | 2'48" |
| Spec | 0'50" max | 5'00" min | | |
| 1.5% sea water on 3.0 liters gasoline | | | 0.07 gpm 2.69 $ft^2$ tank | |
| A. 79 | 0'36" | 7'43" | 4.05 | 2'12" |
| B. 67 | 0'34" | 7'07" | 4.15 | 2'24" |
| C. 70 | 0'36" | 6'40" | 4.37 | 2'18" |

In Example 3, composition A was the control. In composition B, the perfluoroalkyl surfactants were decreased and the alkyl polyglycoside remained the same. In composition C, the alkyl polyglycoside was increased and the perfluoroalkyl surfactants further decreased. In testing according to the modified test, Mil-F-24385C., as described above for Example 1, equal or better results were achieved with the compositions of the invention.

Example 4

| Materials | A | B | 1 liter C |
|---|---|---|---|
| 1. Water | 804 ml | 804 ml | 804 ml |
| 2. Butyl carbitol | 38 ml | 38 ml | 38 ml |
| 3. Xanthan gum | 13.2 g | 10.9 g | 8.5 g |
| 4. G-4-40 | 2.5 g | 2.5 g | 2.5 g |
| 5. Forafac 1157N | 47.8 g | 47.8 g | 47.8 g |
| 6. APG-325 | 44.0 g | 44.0 g | 44.0 g |
| 7. Sodium decylsulfate | 79 ml | 79 ml | 79 ml |
| 8. NTA/$Na_3$ | 1.6 g | 1.6 g | 1.6 g |
| 9. Tris Amino | 1.6 g | 1.6 g | 1.6 g |
| 10. Acetic Acid/50% NaOH to adjust pH 7.6–8.0 | | | |

Viscosity Curves
Brookfield

| | | | |
|---|---|---|---|
| Spindle 3 at 3 RPM | 33,200 cps | 23,440 cps | 15,360 cps |
| 6 RPM | 17,280 cps | 12,480 cps | 8,440 cps |
| 12 RPM | 8,900 cps | 6,460 cps | 4,590 cps |
| 60 RPM | off scale | 1,608 cps | 1,118 cps |

Fire Test Results
Modified UL-162

| Exp | 25% drain | 90% Control | Ext. | 20% Burnback |
|---|---|---|---|---|
| 3% sea water on 3.0 liters heptane | | | | 0.04 gpm 2.69 $ft^3$ tank |
| A. 7.3 | 6'42" | 0'37" | — | 3'59" |
| B. 7.58 | 7'35" | 0'37" | — | 5'00" |
| C. 6.97 | 4'20" | 0'37" | — | 4'20" |
| Spec 3.5 min | 2'00" min | 0'50" max | N/A | 3'00"min |

-continued

Fire Test Results
Modified UL-162

| Exp | 25% drain | 90% Control | Ext. | 20% Burnback |
|---|---|---|---|---|
| 6% sea water on 15 liters IPA (99%) | | | | 0.10 gpm 2.69 $ft^2$ tank |
| A. 9.83 | 20'46" | 0'42" | 1'05" | 8'15" |
| B. 9.79 | 17'05" | 0'38" | 0'56" | 9'00" |
| C. 9.67 | 13'10" | 0'30" | 0'53" | 7'30" |
| Spec 7.0 min | 10'00" min | 1'15" max | 1'45" max | 2'00" max 5'00" min |

Viscosity Curves
Brookfield

| | | | |
|---|---|---|---|
| Spindle 3 at 3 RPM | 33,200 cps | 23,440 cps | 15,360 cps |
| 6 RPM | 17,280 cps | 12,480 cps | 8,440 cps |
| 12 RPM | 8,900 cps | 6.460 cps | 4,590 cps |
| 30 RPM | 3,884 cps | 2,848 cps | 2,024 cps |
| 60 RPM | off scale | 1,608 cps | 1,118 cps |

Fire tests were run pursuant to the modified UL tests previously described.

Composition A was a standard ARAFFF composition. As the amount of polymer (xanthan gum) decreased the viscosity decreased. Thus, less polymer could be used with better or superior results with the presence of the alkyl polyglycoside.

Example 5

| Materials | A | 1022 g B |
|---|---|---|
| 1. Water | 805 g | 775 g |
| 2. Butyl carbitol | 34 g | 34 g |
| 3. Rhodopol 23 | 5.5 g | 5.5 g |
| 4. Forafac 1157N | 47.8 g | 47.8 g |
| 5. APG-325 CS | 44.0 g | 0 g |
| 6. Sodium decylsulfate | 83.7 g | 157.1 g |
| 7. $Na_4$ EDTA | 1.0 g | 1.0 g |
| 8. KATHON CG ICP 1.0 | g 1.0 | g |
| 9. Acetic Acid/40% NaOH to adjust pH 7.6–8.0 | | |

Fire Test Results
Short UL Type III

| Exp. | QDT | 98% Control | Ext | 20% Burnback |
|---|---|---|---|---|
| 3% sea water on 3.0 liters heptane | | | | 0.04 gpm 2.69 $ft^2$ tank |
| A. 8.10 | 9'01" | 1'42" | — | 5'45" |
| B. 8.51 | 5'31" | 1'14" | 1'28" | 4'31" |
| Spec. 6.0–9.2 | 3'50"–13'35" | 30"–2'00" | 30"–2'00" | 3'45"–9'35" |
| 6% sea water on 15 liters IPA | | | | 0.10 gpm 2.69 $ft^2$ tank |
| A. 10.10 | 10'52" | 1'26" | 1'34" | 6'58" |
| B. 10.99 | 9'01" | 0'59" | 1'14" | 4'57" |
| Spec. 8.6–11.6 | 8'45"–30' | 30"–1'05" | 30"–1'05" | 5'00"–12'00" |

In Example 5 the polymer (Rhodopol 23) content is decreased substantially in the ARAFFF composition. However, even with the lower polymer content, Composition A containing the APG demonstrates an enhanced performance with regard to burnback resistance.

Example 6

| Materials | A | 1023 g B |
|---|---|---|
| 1. Water | 835.6 g | 881.3 g |

-continued

Example 6

| Materials | A | 1023 g B |
|---|---|---|
| 2. Butyl carbitol | 38 ml | 38 ml |
| 3. Rhodopol 23 | 8.5 g | 8.5 g |
| 4. G-4-40 | 2.5 g | 2.5 g |
| 5. Forafac 1157N | 47.8 g | 47.8 g |
| 5. APG-325 CS | 91.4 g | -0- g |
| 7. Triton X-102 | -0- g | 45.7 g |
| 8. NTA/$Na_3$ | 1.6 g | 1.6 g |
| 9. Tris Amino | 1.6 g | 1.6 g |
| 10. Acetic Acid/40% NaOH to adjust pH 7.6–8.0 | | |

Fire Test Results
Short UL Type III

| Exp. | 25% Drainage | 98% Control | Ext | 20% Burnback |
|---|---|---|---|---|
| 3% sea water on 10.0 liters heptane | | | | 0.04 gpm 2.69 ft² tank |
| A. 6.94 | 4'43" | 1'09" | — | 5'01" |
| B. 8.00 | 6'10" | 1'01" | 1'26" | 3'59" |
| Spec. 6.0–9.2 | 3'50"–13'35" | 30"–2'00" | 30"–2'00" | 3'45"–9'35" |
| 6% sea water on 15 liters IPA (99%) | | | | 0.10 gpm 2.69 ft² tank |
| A. 6.85 | 21'25" | 1'25" | 1'46" | 6'10" |
| B. 3.77 | 19'00" | no control | (3'00") | — |
| Spec. 8.6–11.6 | 30"–1'05" | 30"–1'05" | 30"–1'05" | 5'00"–12'00" |

Example 6 demonstrates the effect of substituting a nonionic surfactant, Triton X-102, for the APG in an ARAFFF alcohol resistant composition. Enhanced performance due to the APG is demonstrated in hydrocarbon fire test performance and particularly in polar solvent performance, where the composition containing only the Triton X-102 in place of the APG failed to extinguish the IPA fire.

Example 7

| Materials | A | 3.785 kg B |
|---|---|---|
| 1. Water | 2330 g | 1876.2 g |
| 2. Butyl carbitol | 340.7 g | 340.7 g |
| 3. Forafac 1157N | 227.1 g | 227.1 g |
| 4. APG-325 CS | 681.3 g | -0- g |
| 5. Sodium decylsulfate | -0- | 1135.1 g |
| 6. Tolyltriazole | 3.8 g | 3.8 g |
| 7. Ethylene glycol | 227.1 g | 227.1 g |
| 8. Tris Amino | 3.8 g | 3.8 g |
| 9. Urea | 75.7 g | 75.7 g |
| 10. Acetic Acid to adjust pH 7.4–7.8 | | |

Fire Test Results
Mil Spec

| Exp. | QDT | Ext | 25% Burnback | Interfacial Tension dynes/cm |
|---|---|---|---|---|
| 3% sea water on 3.0 liters gasoline | | | | 0.04 gpm 50 ft² tank |
| A. 7'63" | 2'43" | 0'49" | 6'00" | 2.15 |
| B. 10'10" | 2'53" | [0'52"] | [4'55"] | 2.95 |
| Spec | | 50" max | 6'00" min | |

In Example 7, Sodium decylsulfate was substituted for the APG in an AFFF system. Performance, particularly burnback time, is greatly improved for Composition A containing solely APG, despite the low interfacial tensions demonstrated. Compound B without the APG failed to pass the Mil Spec requirements for Ext. and 25% burnback.

Example 8

| Materials | A | B | C |
|---|---|---|---|
| 1. Water | 180 ml | 182 ml | 194 ml |
| 2. Butyl carbitol | 47.3 ml | 47.3 ml | 47.3 ml |
| 3. K78-220B | 8.8 g | -0- | -0- g |
| 4. Forafac 1157N | 21.4 g | 27.9 g | 11.2 g |
| 5. Propylene glycol | 39.5 g | 39.5 g | 39.5 ml |
| 6. IDC - 810M | 37.4 g | 37.4 g | 37.4 ml |
| 7. APG - 325 | -0- | -0- | -0- |
| 8. Tris Amino | -0- | -0- | -0- |
| 9. Sodium decylsulfate | 46.6 ml | 46.6 ml | 46.6 ml |
| 10. Triton X-102 | 2.1 ml | 2.1 ml | 2.1 ml |
| 11. Vanate TS | -0- | -0- | -0- |
| 12. Acetic acid to adjust pH 7.6–8.0 | | | |

| Materials | D | E | F |
|---|---|---|---|
| 1. Water | 198 ml | 195 ml | 204 ml |
| 2. Butyl carbitol | 47.3 ml | 47.3 ml | 47.3 ml |
| 3. K78-220B | -0- | -0- | -0- |
| 4. Forafac 1157N | 11.2 g | 11.2 g | 11.2 g |
| 5. Propylene glycol | 39.5 g | 39.5 g | 39.5 ml |
| 6. IDC - 810M | 37.4 g | 37.4 g | 37.4 g |
| 7. APG - 325 | -0- | -0- | -0- |
| 8. Tris Amino | -0- | -0- | -0- |
| 9. Sodium decylsulfate | 37.3 ml | 37.3 ml | 37.3 ml |
| 10. Triton X-102 | 2.1 ml | 2.1 ml | 2.1 ml |
| 11. Vanate TS | -0- | 2.6 g | 2.6 g |
| 12. Acetic acid to adjust pH 7.6–8.0 | | | |

Fire Test Results
Short UL Type III

| Exp. | QDT | 90% Control | 98% Control | Ext | 20% Burnback |
|---|---|---|---|---|---|
| 3% sea water on 10.0 liters heptane | | | | 0.04 gpm 2.69 ft² tank | |
| A. 11.6 | 4'45" | 0'50" | 1'00" | — | 4'35" |
| B. 11.36 | 3'29" | 0'48" | 1'00" | — | 4'20" |
| C. 11.45 | 3'33" | 0'44" | 1'00" | 1'04" | [2'30"] |
| D. 11.63 | 3'56" | 0'50" | 1'14" | 1'22" | [3'05"] |
| E. 11.15 | 2'37" | 0'46" | 1'00" | 1'18" | [3'00"] |
| F. 11.68 | 3'40" | 0'57" | 1'30" | 1'53" | 4'40" |
| Spec 7.0 min | 2'30" | | 2'00" max | N/A | 4'00" min |

Example 8 presents a comparison of several different formulations. Composition A contains a nonionic perfluoroalkyl surfactant, K78-220B, combined with an amphoteric perfluoroalkyl surfactant, Forafac 1157N. In Composition B the nonionic perfluoroalkyl surfactant was omitted and replaced with 6.5 additional grams of amphoteric surfactant. The resulting effectiveness of both compositions remained essentially equal indicating that it makes no significant difference if the nonionic perfluoroalkyl surfactant is used in combination with or as a partial replacement for the amphoteric perfluoroalkyl surfactant.

In Compositions C–F the amount of perfluoroalkyl surfactant was decreased to about 40% of the customary recommended level. In C–E, two conventional foamers were used (i.e. IDC-810M and Sodium decylsulfate) to replace the APG, and all three compositions had significantly poorer burnback values as compared to Composition F, which contains APG. In Composition F, the IDC-810 was totally replaced by APG and minor amounts of a buffering agent and a sequestering agent to insure mixing. Composition F exceeded the performance of the standard Composition A in all respects. It should be noted that the amount of Sodium decylsulfate present in Composition F was significantly less than that used in Compositions A or B.

Example 9

| Materials | A | 4 liters B |
|---|---|---|
| 1. Water | 2834 g | 292.4 g |
| 2. Lodyne S-106A | 8.0 g | 8.0 g |
| 3. Lodyne S-103A | 140.4 g | 140.4 g |
| 4. Lodyne K81'84 | 25.2 g | 25.2 g |
| 5. Butyl carbitol | 736 g | 736 g |
| 6. Deteric LP | 226.8 g | -0- |
| 7. Triton X-102 | 30 g | 30 g |
| 8. APG-325 CS | -0- | 136.1 g |
| 9. Acetic acid/40% NaOH to adjust pH 7.8-8.0 | | |

Fire Test Results

| Exp. | QDT | Summation | Ext | 25% Burnback |
|---|---|---|---|---|
| 3% sea water on 15 gallons of gasoline | | | | 0.04 gpm/ft$^3$ 50 ft$^2$ tank |
| A. 6.17 | 3'30" | 0'44" | 0'44" | 4'45" |
| B. 5.52 | 3'00" | 0'50" | 0'50" | 6'00" |
| Spec | | | 50" max | 6'00" min |

In Example 9 a cationic perfluoroalkyl surfactant, Lodyne S-106A, an anionic perfluoroalkyl surfactant, Lodyne S-103A, and a nonionic perfluoroalkyl surfactant, Lodyne K81'84, were combined.

Composition B containing the alkylpolyglycoside outperformed the formulation containing solely the Deteric LP. The combination of the three types of perfluoroalkyl surfactants had no detrimental effect on the enhanced performance demonstrated by the APG containing composition.

It is fully understood that all of the foregoing Examples are intended to be merely illustrative and not to be construed or interpreted as being restrictive or otherwise limiting of the present invention, excepting as set forth and defined in the hereto appended claims.

What is claimed is:

1. A foamable firefighting concentrate composition comprising: perfluoroalkyl surfactants, a solvent and an effective amount of alkyl polyglycoside sufficient to permit a reduction in the concentration of the perfluoroalkyl surfactant without loss of firefighting performance by the composition, said alkyl polyglycoside present in an amount from between about 1.0 to 10.0% by weight.

2. The composition of claim 1 further comprising a water soluble heteropolysaccharide polymer.

3. The composition of claim 2 wherein the perfluoroalkyl surfactants are present in an amount from between about 0.5 to 3% by weight.

4. The composition of claim 3 wherein the perfluoroalkyl surfactants are amphoteric surfactants.

5. The composition of claim 4 further comprising non-fluorinated surfactants.

6. The composition of claim 5 wherein the solvent is selected from the group consisting of glycols and glycol ethers.

7. The composition of claim 1 wherein the alkyl polyglycoside comprises:

$R_1—O—R_2$ wherein $R_1$ is a polysaccharide of the formula

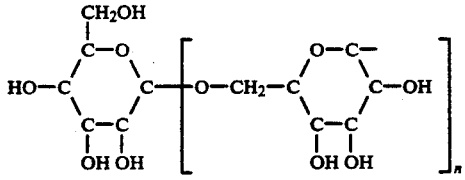

wherein n equals 1 to 5, and $R_2$ is an alkyl group of the formula $C_2H_{2n+1}$, where n equals 4 to 18.

8. The composition of claim 7 further comprising a water soluble heteropolysaccharide based polymer.

9. The composition of claim 8 wherein the perfluoroalkyl surfactants are present in an amount from between about 0.5 to 3% by weight.

10. The composition of claim 9 wherein the perfluoroalkyl surfactants are amphoteric surfactants.

11. The composition of claim 10 further comprising non-fluorinated surfactants.

12. The composition of claim 11 wherein the solvent is selected from the group consisting of glycols and glycol ethers.

13. The composition of claim 1 wherein the perfluoroalkyl surfactants are selected from the group consisting of anionic, cationic, nonionic and amphoteric surfactants.

14. The composition of claim 13 wherein the perfluoralkyl surfactants are amphoteric surfactants.

15. The composition of claim 13 further comprising non-fluorinated surfactants.

16. The composition of claim 15 wherein the non-fluorinated surfactants are selected from the group consisting of anionic, cationic, nonionic and amphoteric surfactants.

17. The composition of claim 16 wherein the solvent is selected from the group consisting of glycols and glycol ethers.

18. The composition of claim 17 further comprising a water soluble heteropolysaccharide polymer.

19. The composition of claim 18, wherein the heteropolysaccharide polymer is selected from the group consisting of xanthan gum, gum tragacanth, locust bean gum, guar gum and K8A13.

20. The composition of claim 19 wherein the perfluoroalkyl surfactants are present in an amount from between about 0.5 to 3% by weight.

21. The composition of claim 20 wherein the heteropolysaccharide polymer is present in an amount from between about 0.5 to 1.5%, by weight.

22. The composition of claim 13 further comprising a water soluble heteropolysaccharide polymer.

23. The composition of claim 23 wherein the perfluoroalkyl surfactants are present in an amount from between about 0.5 to 3% by weight.

24. The composition of claim 23 wherein the perfluoroalkyl surfactants are amphoteric surfactants.

25. The composition of claim 24 further comprising non-fluorinated surfactants.

26. The composition of claim 25 wherein the solvent is selected from the group consisting of glycols and glycol ethers.

27. An aqueous film forming concentrate composition for dilution with water and suitable for foaming with air to produce a firefighting foam, said composition consisting essentially of the following components in the indicated percentages by weight:

| | |
|---|---|
| Perfluoralkyl surfactant(s) | 0.5–3.0% |
| Alkyl polyglycoside surfactant(s) | 1.0–10.0% |
| Glycol | 0–10.0% |
| Glycol ether | 4.0–20.0% |
| Magnesium sulfate | 0–1.0% |
| Anionic surfactant(s) | 0.0–6.0% |
| Nonionic surfactant(s) | 0.0–2.0% |
| Sequestering agent(s) | 0–1.0% |
| Buffering agent(s) | 0–2.0% |
| Corrosion inhibitor(s) | 0–2.0% |
| Water | Balance |

28. An aqueous film forming concentrate composition for dilution with water suitable for foaming with air to produce a firefighting foam, said composition consisting essentially of the following components in the indicated percentage by weight:

| | |
|---|---|
| Perfluoroalkyl surfactant(s) | 0.8–2.0% |
| Alkyl polyglycoside surfactant(s) | 1.0–10.0% |
| Glycol | 0–5.0% |
| Glycol ether | 2.0–5.0% |
| Magnesium sulfate | 0–1.0% |
| Anionic surfactant(s) | 2.0–5.0% |
| Sequestering agent(s) | 0.1–1.0% |
| Buffering agent | 0–2.0% |
| Preservative(s) | 0–1.5% |
| Heteropolysaccharide polymer | 0.5–1.5% |
| Water | Balance |

29. An aqueous film forming concentrate composition for dilution with water suitable for foaming with air to produce a firefighting foam, said composition consisting essentially of the following components in the indicated percentage by weight:

| | |
|---|---|
| Perfluoroalkyl surfactant(s) | 0.8–2.0% |
| Alkyl polyglycoside surfactant(s) | 1.0–10.0% |
| Glycol ether | 2.0–5.0% |
| Glycol | 0–5.0% |
| Magnesium sulfate | 0.0–2.0% |
| Heteropolysaccharide polymer | 1.0–2.0% |
| Anionic surfactant(s) | 0–5.0% |
| Buffering agent(s) | 0–2.0% |
| Sequestering agent(s) | 0.1–1.0% |
| Water | |

30. A foamable, firefighting concentrate composition comprising by weight:

| | |
|---|---|
| Glycol Ether | 2.0–5.0% |
| Heteropolysaccharide polymer | 0.5–1.5% |
| Perfluoroalkyl surfactant | 0.8–2.0% |
| Alkylpolyglycoside | 1.0–10.0% |
| Anionic surfactant | 0.0–5.0% |
| Water | qs |

31. A foamable, firefighting concentrate composition comprising by weight:

| | |
|---|---|
| Glycol Ether | 2.0–5.0% |
| Heteropolysaccharide polymer | 1.0–2.0% |
| Perfluoroalkyl surfactant | 0.5–3.0% |
| Alkylpolyglycoside | 1.0–10.0% |
| Anionic surfactant | 0.0–5.0% |
| Water | qs |

32. A foamable, firefighting concentrate composition comprising by weight:

| | |
|---|---|
| Glycol Ether | 0.0–10.0% |
| Glycol Ether | 4.0–20.0% |
| Perfluoroalkyl surfactant | 0.5–3.0% |
| Alkylpolyglycoside | 1.0–10.0% |
| Anionic surfactant | 0.0–6.0% |
| Water | qs |

* * * * *

UNITED STATES PATENT AND TRADEMARK OFFICE

CERTIFICATE OF CORRECTION

PATENT NO. : 5,207,932

DATED : May 4, 1993

INVENTOR(S) : Edward C. Norman and Anne C. Regina

It is certified that error appears in the above-identified patent and that said Letters Patent is hereby corrected as shown below:

Column 4, line 35, change the word "nionic" to --Anionic--;

Column 5, lines 37 and 38, change that portion of the formula reading "$+(CH_3)_2CH_{21}COO^-$" to --$^+(CH_3)_2CH_2COO^-$--;

Column 6, line 37, change "40 cc/m." to --40cc/sec.--;

Column 7, line 5, change "100 cc/m." to --100cc/sec.--;

Column 8, line 12, change "IDC-819M" to --IDC-810M--;

Column 12, Example 8, Col. F, No. 6., change "37.4 g" to --0--;

Column 12, Example 8, Col. F, No. 7., change "0" to --28.0g--;

Column 12, Example 8. Col. F, No. 8., change "0" to --1.5g--;

Column 14, line 62 , change "23" to --22--.

Signed and Sealed this

Twenty-fourth Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. :5,207,932

DATED :May 4, 1993

INVENTOR(S) : Edward C. Norman and Anne C. Regina

It is certified that error appears in the above-identified patent and that said Letters Patent is hereby corrected as shown below:

On the title page:

--[* ] Notice: The portion of the term of this patent subsequent to March 12, 2008 has been disclaimed.--

Signed and Sealed this

Fifteenth Day of October, 1996

*Attest:*

Bruce Lehman

BRUCE LEHMAN

*Attesting Officer*

*Commissioner of Patents and Trademarks*